US005287943A

United States Patent [19]

Bell

[11] Patent Number: 5,287,943

[45] Date of Patent: Feb. 22, 1994

[54] DUAL CONNECTION LANYARD FOR USE IN SAFETY SYSTEM

[76] Inventor: Michael Bell, 1705 Triumphe Way, Warrington, Pa. 19876

[21] Appl. No.: 816,990

[22] Filed: Jan. 3, 1992

[51] Int. Cl.[5] ..... A47L 3/00

[52] U.S. Cl. ..... 182/3

[58] Field of Search ..... 182/3, 4, 5, 7, 9

[56] References Cited

U.S. PATENT DOCUMENTS

| | | | |
|---|---|---|---|
| 2,626,447 | 1/1953 | Hunt | 182/3 X |
| 5,090,503 | 2/1992 | Bell | 182/5 |
| 5,165,499 | 11/1992 | Bell | 182/9 |

OTHER PUBLICATIONS 3 photographs of the Rose lanyard.

*Primary Examiner*—Blair M. Johnson

*Attorney, Agent, or Firm*—Caesar, Rivise, Bernstein, Cohen & Pokotilow, Ltd.

[57] ABSTRACT

A lanyard for connection to safety device, e.g., a belt or harness, worn by a worker and for connection to an anchor point. The lanyard is arranged to be used in a method to prevent the worker from falling. The lanyard comprising a flexible member, e.g., nylon or polyester webbing, having first, second, and third, elongated sections, each of the sections having a first end and a second end. The second ends of all of the sections are connected, e.g., sewn, to one another. Each of the first ends of the lanyard includes a respective connector, e.g., a clasp, mounted thereon. In accordance with the method of use the connector of the first section is releasably secured to the safety device, while the connectors of the second and third sections are releasably secured to the anchor point. A shock absorber may be included in the first section of the lanyard.

8 Claims, 2 Drawing Sheets

FIG. 1
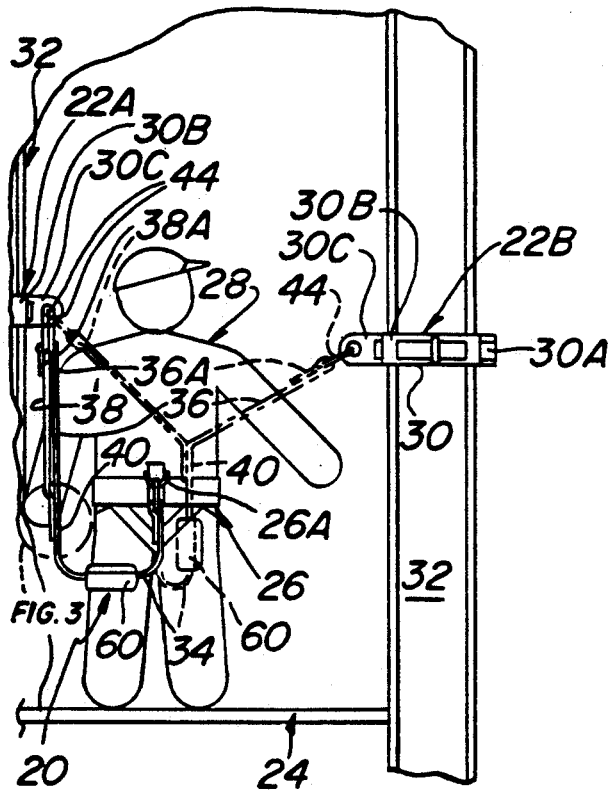
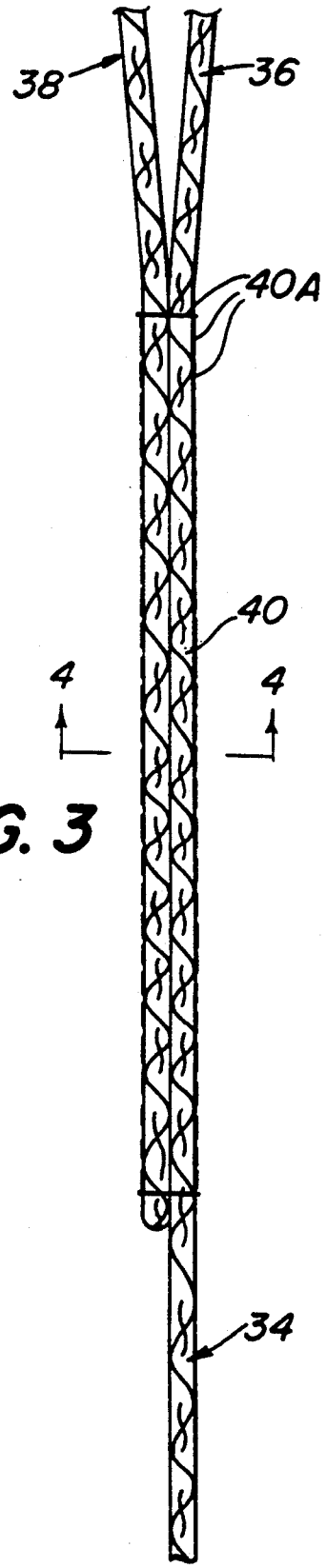
FIG. 3
FIG. 4
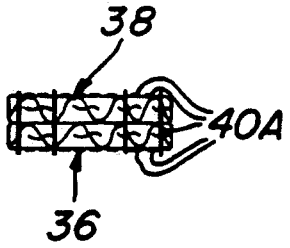

44
44
44A
44A
48
50
52
36A
38A
52
38
36
66B
66A
66
68
70
62
60
64
34
34
20
34A
52
40A
46
40
44
44A

DUAL CONNECTION LANYARD FOR USE IN SAFETY SYSTEM

BACKGROUND OF THE INVENTION

This invention relates generally to safety apparatus and more particularly to a dual connection lanyard for securement to structural components of a building to protect workers thereon from falling.

Due to the enactment of various safety laws, persons working at elevated positions, e.g., on steel construction beams of a building as it is erected, are required to be protected against falls. One common approach to achieve that end is by the use of a safety belt or harness which is worn by the worker and which is arranged to be connected to a fixed anchor point. To that end the belt or harness includes a D-ring or some other metal loop fixedly mounted on it in the center of the portion located at the worker's back. The D-ring is arranged to be "tied off" (connected), via a lanyard, to a fixed supporting member (the "anchor point"). The anchor point may be any fixed portion, e.g. an I-beam, of the building. Thus, once the worker is tied off should he/she fall off of the structure he/she will be prevented from falling to the ground.

While prior art lanyards are generally suitable for their intended purpose of preventing the worker from falling, they never the less suffer from some drawbacks. For example, prior art lanyards limit or restrict the movement of the worker to a small working area contiguous with the location of the anchor point. Moreover, prior art lanyards do not provide means to enable the worker to be protected from a fall when the worker disconnects himself/herself from one anchor point to connect himself/herself to another anchor point, e.g., an anchor point at a different location.

OBJECTS OF THE INVENTION

Accordingly, it is a general object of this invention to provide a lanyard for use in a safety system which overcomes the disadvantages of the prior art.

It is a further object of this invention to provide a lanyard which permits a worker to move about an anchor point to which he/she is connected by the lanyard with a substantial degree of freedom, while nevertheless protecting the worker from falling.

It is another object of this invention to provide a lanyard which enables the worker to be protected from a fall while enabling the worker to connect and disconnect himself/herself to various anchor points.

It is still another object of this invention to provide a lanyard which is simple in construction and low in cost.

SUMMARY OF THE INVENTION

These and other objects of this invention are achieved by providing a lanyard for connection to safety device worn by a worker and for connection to an anchor point to prevent the worker from falling more than a predetermined distance from the anchor point. The lanyard comprises a flexible member having first, second, and third, elongated sections, with each of the sections having a first end and a second end. The second ends of all of the sections are connected to one another. Each of the first ends of all of the sections includes a respective connector member mounted thereon.

In accordance with the method of this invention the connector member of the first section is releasably secured to the safety device worn by the worker and both of the second and third sections of the lanyard means are connected to a first anchor point to protect the worker from falling. When the worker desires to move to another location a first one of the second or third sections is disconnected from the first anchor point and connected to a second anchor point spaced from the first anchor point. Once that is accomplished the other of the second and third sections is disconnected from the first anchor point and connected to the second anchor point. This enables the worker to change anchor points, all the while being protected from a fall.

If desired, a shock absorber may be connected to the lanyard to absorb the shock which will occur when the lanyard operates to halt the fall of a worker. The subject invention, however, need not make use of a shock absorber, although that is one preferred embodiment of this invention (to be described later).

The lanyard of this invention can be used in any application wherein a worker is to be connected to an anchor point, either fixed or moveable, to protect the worker from falling. For example, in my copending U.S. patent application Ser. No. 07/834,421 filed on Feb. 12, 1992, entitled Safety System For Use In Erecting Static Structures, whose disclosure is incorporated by reference herein, there is disclosed one type of application in which the lanyard may be used.

DESCRIPTION OF THE DRAWINGS

Other objects and many attendant features of this invention will become readily appreciated as the same becomes better understood by reference to the following detailed description when considered in connection with the accompanying drawings wherein:

FIG. 1 is a front view of a worker utilizing the lanyard of the subject invention;

FIG. 3 is an enlarged sectional view of the portion of the lanyard shown within the area designated by the legend "FIG. 3" in FIG. 1; and FIG. 4 is a sectional view taken along line 4—4 of FIG. 3.

DETAILED DESCRIPTION OF THE PREFERRED EMBODIMENTS

Figure 2:
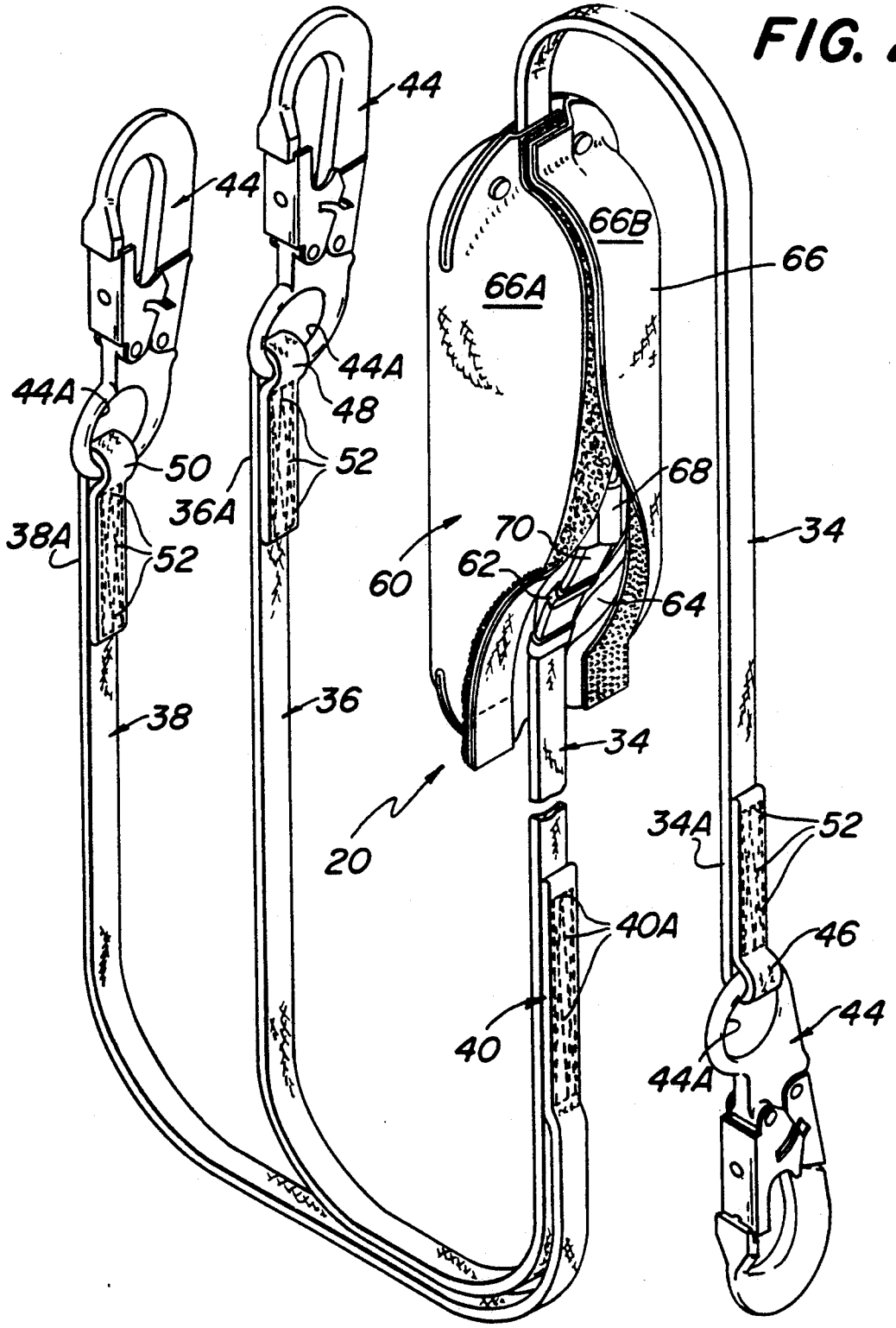
FIG. 2 is an enlarged sectional view of the lanyard shown in FIG. 1.

Referring now to the various figures of the drawing wherein like reference characters refer to like parts, there is shown at 20 in FIG. 1, lanyard constructed in accordance with this invention. The lanyard 20 is arranged to be connected to some fixed anchor point 22A on a building 24 or some other structure and to a safety device 26 worn by a worker 28 located adjacent the anchor point to prevent the worker from falling off the building or structure. The safety device 26 may be any suitable member, e.g., a belt or harness. In the embodiment shown herein the safety device comprises a harness. The harness 26 includes a connector member, e.g., a conventional D-ring 26A, mounted on the rear thereof. This D-ring serves as the means for connecting the lanyard 20 to the harness 26.

The fixed anchor point 22A may be any suitable element located on or adjacent the structure at which the worker is located. In the embodiment shown herein the anchor point 22A is formed by an anchor device 30 constructed in accordance with the teachings of my copending U.S. patent application Ser. No. 07/761,121, filed on Sep. 17, 1991, U.S. Pat. No. 5,165,499, entitled Anchor System For Use With Fall Prevention Safety Devices, whose disclosure is incorporated by reference herein. The device 30 is releasably secured to a portion of an I-beam 32 of the building 24. The device 30 basically comprises a ratchet assembly (not shown), a flexible strap 30A, a sleeve 30B mounted on the strap, and a conventional D-ring connector 30C mounted on the sleeve 30B. The strap 30A is arranged to encircle and frictionally engage the I-beam 32, with the ratchet assembly locking it tightly in place thereon. The D-ring 30C serves as the means for connecting the lanyard 20 to the device 30.

Referring now to FIG. 2 the details of the lanyard 20 will now be described. As can be seen therein the lanyard 20 basically comprises plural, e.g., two, straps of a strong, light weight, flexible, material, e.g., woven polyester, nylon, KEVLAR (Registered Trademark) etc., which are secured together to form three strap sections, namely, a common strap section 34 and a pair of strap sections 36 and 38. Each of the strap sections 34, 36 and 38 is an elongated member which includes a free end designated by the identifier "A". Thus, the common section 34 includes a free end 34A, the section 36 includes a free end 36A, and the section 38 includes a free end 38A. The opposite end of each of the sections are secured together at a joint 40.

The sections 34, 36, and 38 may each comprise a respective separate strip or web of material. However, in accordance with a preferred embodiment of this invention the sections 34 and 36 are formed of a unitary strap or web member, while the section 38 is formed of a separate and distinct web member. In such a case the web member forming the strap section 38 is secured to the interface of the strap sections 34 and 36 madding up of the unitary web member to form the joint 40. The joint 40 is made by overlapping a substantially portion, e.g., six inches (15.2 cm), of the web section 38 over the interface of web member 34 and 36 and stitching the overlapping portions together via plural stitch lines 40A (FIGS. 3 and 4). If desired, plural rivets may be provided to reinforce the joint.

Each of the strap sections 36 and 38 is arranged to be connected to the anchor point 22A. It should be pointed out at this juncture that the anchor point to which the lanyard 20 can be connected may be any fixed member, e.g., an I-beam, etc., of the structure on which the worker is working or it may be a moveable member, e.g., a conventional rope-grab, or a sliding anchor such as disclosed in my copending U.S. patent application Ser. No. 07/771,666, filed on Oct. 4, 1991, U.S. Pat. No. 5150766, entitled Sliding Anchor System And Method Of Use, whose disclosure is also incorporated by reference herein. In any case, the common lanyard section 34 is arranged to be connected to a waist belt or harness which is worn by the worker to be protected. In the embodiment shown herein the lanyard section 34 is connected to the D-ring 26A on the rear of the harness 26.

Each of the ends of the lanyard sections 34, 36, and 38 includes a conventional spring-loaded clasp 44 fixedly secured thereto to enable the lanyard to be releasably connected as desired. It should be pointed out at this juncture that other types of releasably securable connectors, e.g., carabiners, etc., can be used in lieu of the spring-loaded clasps 44.

As shown in FIG. 1 the free end of each of the lanyard sections 34, 36, and 38 is extended through a hole 44A in a respective clasp 44 and folded over itself to form respective loops 46, 48, and 50. Each loop 46, 48, and 50 is closed off by plural lines of stitches 52 to fixedly secure a respective clasp 44 thereto. If desired, rivets may also be provided to strengthen the connection. Moreover, if desired, the inside of each loop may contain a conventional guard (not shown) of metal or some other durable material to prevent the clasp 44 from frictionally damaging the lanyard section to which it is secured.

In accordance with a preferred embodiment of this invention when the strap sections are secured to each other as described above, the length of each of the strap sections 36 and 38 measured to the end of the clasp mounted thereon, is at least eighteen inches (45.7 cm), and the length of the common strap section 34, measured to the end of its clasp, is at least forty eight inches (122 cm).

The lanyard 20 may be used in various ways. One such way is shown in FIG. 1 and is as follows. The worker 28 connects the clasp 44 on the common lanyard section 34 to the D-ring 26A on his/her harness 26. Then he/she connects the clasps 44 at the ends of the lanyard sections 36 and 38 to anchor point 22A on the building 24 adjacent the position at which he/she is working. Once the lanyard is connected as just described, the worker is protected from falling off of the structure 24 on which he/she is working. In this regard should the worker fall off of the structure he/she will only be able to drop the distance corresponding to the length of the lanyard 20, and if a shock absorber is used, the length of a folded portion (to be described later) of the shock absorber, below the anchor point 22A.

The subject lanyard 20 offers the worker 28 a greater degree of operating space and freedom of movement than conventional lanyards. In this regard should the worker wish to move to another position on the structure 24 which is adjacent to his/her present position, e.g., to a second anchor point 22B located a distance from the first anchor point 22A, all that is required is for the worker to disconnect either, but not both, of the strap sections 36 or 38 from the anchor point 22A to which they are connected. As shown by the phantom lines in FIG. 1 the disconnected strap section is section 36 (but it could have just as easily been section 38). The section 36 can then be extended to connect to another anchor point 22B on the structure 24, all the while leaving the other of the strap sections, namely, section 38, still connected to the first anchor point 22A. Thus, during the time period that the worker is connecting the lanyard section 36 to the new anchor point 22B he/she is assured that he/she is still protected from falling by the lanyard section 38 remaining connected to the first anchor point 22A. Once the strap section 36 is connected to the new anchor point 22B the worker can then disconnect the strap section 38 which is connected to the first anchor point 22A with assurance that he/she is protected from falling by the connection of the strap section 36 to the new anchor point 22B. The worker can then connect the disconnected strap section 38 to the second anchor point 22B to complete his/her securement to the new anchor point. This operation ca be repeated from anchor point to anchor point as many times as desired so that the worker can readily move about the structure 24, yet be protected from falling thereoff.

It must be pointed out at this juncture that the above described operation and use of the lanyard 20 is merely exemplary. Thus, various other uses can be made of the lanyard. For example, the lanyard may be used in the manner as described in my aforementioned copending U.S. patent application Ser. No. 07/834,421 filed on Feb. 2, 1992, entitled Safety System For Use In Erecting Static Structures. In that application the anchor point is in the form of a sliding anchor like that disclosed in my aforenoted U.S. patent application, Ser. No. 07/771,666, U.S. Pat. No. 5,150,766. The sliding anchor basically comprises a flexible, tubular device which is slidably mounted on a rope. The rope is of any conventional construction and is secured by some means, such as a device 30, so that it is adjacent the position of the worker to be protected. The sliding anchor is woven of plural strands of a strong, light weight, material, e.g., nylon, polyester, KEVLAR (Registered Trademark), etc., which are interconnected like a conventional "chinese finger grip" so that the tubular member has a central passageway extending through it between a pair of ends. Each of the ends includes an opening to the interior of the central passageway and an associated loop extending from the edge of the opening. Each of the loops is closed. In order to position the sliding anchor on the rope at a desired position the two ends of the tubular member are pushed towards each other. This causes the elongated tubular member to decrease in length and increase in diameter, so that the internal diameter of its central passageway is greater than the external diameter of the rope. Thus, the anchor can be readily slid to any desired position on the rope. In order to fix or secure the anchor in that position so that it cannot slide with respect to the rope, all that is necessary is to pull the ends of the tubular member apart by gripping its loops and pulling them away from each other. This action causes the tubular member to elongate, and its central passageway to constrict in internal diameter, whereupon, the interior surface of the central passageway tightly engages the exterior surface of the rope. The resulting high friction created by this action precludes the anchor from sliding along the rope. When it is desired to move the anchor, all that is necessary is to grasp the ends of the tubular member and push them towards each other. This action compresses the length of the tubular member, thereby increasing the internal diameter of its central passageway and breaking the frictional engagement between the rope and it, so that anchor can be readily slid therealong.

If a sliding anchor is utilized the connection of the lanyard 20 of this invention to such an anchor is effected by connecting the clasps 44 of lanyard sections 36 and 38, respectively, to either of the loops of the sliding anchor.

As mentioned earlier, the lanyard of this invention can be used alone, or in combination with a shock absorber. If a shock absorber is desired the shock absorber can take any form. Preferably, it is constructed in accordance with the teachings of my copending U.S. patent application Ser. No. 07/605,284 filed on Oct. 29, 1990, entitled Visually Inspectable Safety Lanyard, and whose disclosure is incorporated by reference herein.

In FIG. 2 it can be seen that a shock absorber 60 is incorporated in the lanyard 20. The shock absorber 60 is preferably constructed in accordance with the embodiment of FIGS. 4–6 of my aforenoted patent application Ser. No. 07/605,284, except that instead of using a rope the common strap section 34 is utilized in the shock absorber 60. Thus, as can be seen the shock absorber 60 basically comprises a shock absorbing mechanism 62 housed within an inner, preferably transparent, breakable cover 64. That cover is in turn housed within an outer, readily openable cover 66. The shock absorber mechanism 62 basically comprises a plurality of spaced frictional ferrules 68 (only one of which can be seen) through which a folded portion 70 of the common strap section 34 extends. The ferrules 68 are secured to the folded portion 70 of the strap section 34 with sufficient force to provide the desired shock absorbing function. Thus, when tension is applied to the lanyard 20, such as occurs when the worker falls, the folded portion 70 of the strap section 34 slides relative to the ferrules 68, with the frictional engagement between the ferrules and the folded portion of the strap section absorbing the energy of the shock.

The inner cover 64 of the shock absorber 60 serves to hold the shock-absorbing mechanism 62 in the desired orientation, to prevent it from being subjected to injury, and to provide a means to enable one to readily see if the mechanism either has been tampered with, or has been previously actuated. Thus, the inner cover 62 is a transparent heat shrinkable film which has been shrunk in place over the mechanism. The film stretches, tears or breaks apart when a person either intentionally or inadvertently tampers with the shock absorber mechanism, or when the mechanism has been actuated, such as occurs when a person falls.

The outer cover 66 of the shock absorber 60 is cylindrical in shape and comprises two sections 66A and 66B, each formed of a resilient material, e.g., vinyl. These sections are releasably secured to each other so that they can be readily opened to provide visual access to the inner cover 64.

Without further elaboration, the foregoing will so fully illustrate my invention that others may, by applying current or future knowledge, adopt the same for use under various conditions of service.

I claim:

1. A lanyard for connection to a safety device worn by a worker and for connection to an anchor point to prevent the worker from falling more than a predetermined distance from said anchor point, said lanyard comprising a pair of flexible web members secured together by sewing at a single location to form a first, common elongate section and a second and third elongate section extending from said common section, said common section and one of said second and third sections being part of one of said flexible web members and the other of said second and third sections being provided by the other of said flexible web members being sewn to said one of said flexible web members at said single location intermediate opposed ends of said one of said flexible web members, each of said sections having a first end and a second end, said second ends of all of said sections being connected to one another by the sewing at the single location, each of said first ends including a respective connector member mounted thereon, said connector member of said first section being arranged to be releasably secured to said safety device, said connector members of said second and third sections being arranged to be releasably secured to said anchor point.

2. The lanyard of claim 1 wherein said second and third sections are at least 18 inches (45.7 cm) long.

3. The lanyard of claim 1 additionally comprising shock absorbing means connected thereto.

4. The lanyard of claim 3 wherein said shock absorbing means is connected to said first common elongate section intermediate said first and second ends thereof.

5. The lanyard of claim 1 wherein each of said connector members comprises a lock snap.

6. The lanyard of claim 1 wherein each of said pair of said flexible web members is formed of a woven, high strength material webbing.

7. The lanyard of claim 6 wherein said material is selected from the group comprising nylon and polyester.

8. The lanyard of claim 1 wherein said lanyard is approximately six feet (91.4 cm) long measured from the connector at the end of either of said second or said third sections to the connector at the end of said first section.

* * * * *